US005503128A

United States Patent [19]

Hickey et al.

[11] Patent Number: 5,503,128

[45] Date of Patent: Apr. 2, 1996

[54] DISTORTION CONTROL RING FOR A FUEL INJECTOR

[75] Inventors: Daniel K. Hickey, Greenwood; Chandresh R. Shah, Columbus, both of Ind.

[73] Assignee: Cummins Engine Company, Inc., Columbus, Ind.

[21] Appl. No.: 365,585

[22] Filed: Dec. 28, 1994

[51] Int. Cl.[6] ..... F02M 55/02

[52] U.S. Cl. ..... 123/470; 123/509

[58] Field of Search ..... 123/470, 509, 123/456, 468, 469, 472, 495

[56] References Cited

U.S. PATENT DOCUMENTS

| | | | |
|---|---|---|---|
| 3,387,867 | 6/1968 | Rogers . | |
| 4,133,321 | 1/1979 | Hofmann | 123/470 |
| 4,403,586 | 9/1983 | Taniguchi . | |
| 4,419,977 | 12/1983 | Hillebrand . | |
| 4,528,959 | 7/1985 | Hauser | 123/470 |
| 4,571,161 | 2/1986 | Leblanc et al. . | |
| 4,829,646 | 5/1989 | Cigolotti et al. . | |
| 4,917,069 | 4/1990 | Kuhlen | 123/509 |

FOREIGN PATENT DOCUMENTS

| | | | |
|---|---|---|---|
| 838650 | 11/1939 | France . | |
| 2454081 | 5/1976 | Germany | 123/470 |
| 3010328 | 9/1981 | Germany | 123/470 |
| 0678194 | 8/1979 | U.S.S.R. | 123/470 |
| 2153908 | 8/1985 | United Kingdom | 123/470 |
| 2177450 | 1/1987 | United Kingdom | 123/470 |
| 2177157 | 1/1987 | United Kingdom | 123/470 |

*Primary Examiner*—Carl S. Miller

*Attorney, Agent, or Firm*—Woodard, Emhardt, Naughton, Moriarty & McNett

[57] ABSTRACT

A distortion control ring disposed and connected between a fuel injector body and a clamping device. The distortion control ring is utilized as an intermediary for transmitting a static clamping load from the clamping device to the fuel injector body. The distortion control ring includes a cylindrical shaped main body having a bore extending therethrough between an upper surface and a lower surface. The upper surface of the main body being adapted for mounting a return spring thereon. The lower surface having an annular portion for contacting the fuel injector body. A radial flange is formed on the distortion control ring adjacent to the main body for contacting the clamping device and receiving the static clamping load. The clamping device engages the radial flange at a distance radially outward of where the lower surface of the main body contacts the fuel injector body. This geometric relationship between the radial flange and the lower surface of the main body transfers the static clamping load to a central portion of the fuel injector body. By transferring the static clamping load to a more central portion of the fuel injector body there is a corresponding reduction in the failure rate of fuel injector units.

16 Claims, 3 Drawing Sheets

DISTORTION CONTROL RING FOR A FUEL INJECTOR

BACKGROUND OF THE INVENTION

The present invention relates in general to the design and construction of clamping rings which are used as an intermediary for transmitting static clamping loads from a clamping device to an object. More particularly, the present invention relates to distortion control rings utilized as an intermediary for holding a fuel injector body on the cylinder head of an internal combustion engine.

Many internal combustion engines, whether compression ignition or spark ignition engines, are provided with fuel injection systems to satisfy the need for precise and reliable fuel delivery into the combustion chamber of the engine. Such precision and reliability is necessary to address the goals of increasing fuel efficiency, maximizing power output, and controlling the undesirable by-products of combustion.

A fuel injector is a precision device that must meter the quantity of fuel required for each cycle of the engine and must develop the high pressure necessary to inject the fuel into the combustion chamber at the correct instant of the operating cycle. Many fuel injection units utilize a mechanical linkage from the engine, such as a push rod and rocker arm, to pressurize the fuel charge and obtain the desired fuel spray pattern. The mechanical linkage interacts with a timing plunger that is disposed within a bore formed in the fuel injector for engaging an incompressible liquid fuel. This mechanical pressurization of the liquid fuel produces an extremely high fuel injection pressure, often exceeding 20,000 p.s.i. (13,8000 newtons per square centimeter).

In the past, designers of internal combustion engines have generally used a mechanical clamping device to hold a fuel injection unit on the cylinder head. One approach is to affix a clamping device having a wishbone shaped fork at one end to the cylinder head. The clamping device is bolted to the cylinder head and the forks on the wishbone shaped end contact the outer perimeter of the top surface of the fuel injector body, thereby holding the fuel injector unit in place. A second approach is to utilize a clamping plate that engages a flange formed on the outer perimeter of the fuel injector body. The clamping plate is secured to the engine by a pair of bolts, thereby drawing the flange against the engine block and holding the fuel injector unit in place.

These two approaches of fastening a fuel injector unit to an internal combustion engine have a common limitation. The common limitation being the distortion of the bore formed in the fuel injector body thereby causing timing plunger scuffing, and ultimately the seizure of the timing plunger within the bore. This premature failure of the fuel injector unit is generally attributed to the static clamping load being transmitted to the outer perimeter of the fuel injector body.

In order to try and solve, or at least minimize, the foregoing problem, designers have tried different approaches. For example, there have been a variety of clamping rings, for transferring static clamping loads produced by clamping devices conceived of over the years. The following listing of references is believed to be representative of such earlier designs.

REFERENCES

| Patent No. | Patentee | Issue Date |
|---|---|---|
| 4,829,646 | Cigolotti et al. | May 16, 1989 |
| 4,571,161 | Leblanc et al. | Feb. 18, 1986 |
| 4,419,977 | Hillebrand | Dec. 13, 1983 |
| 4,403,586 | Taniguchi | Sept. 13, 1983 |
| 3,387,867 | Rogers | June 11, 1968 |
| **Patent No.** | **Applicant** | **Date** |
| French No. 838,650 | Fives-Lille Company | March 10, 1939 |

Even with a variety of earlier designs, there remains a need for a distortion control ring that is easy to install and which minimizes the hold down clamp load transmitted to the outer perimeter of the fuel injector body, thereby reducing the distortion of the bore formed in the fuel injector body. The present invention satisfies this need in a novel and unobvious way.

SUMMARY OF THE INVENTION

To address the unmet needs of the prior fuel injector unit mounting devices, the present invention contemplates an apparatus for securing a fuel injector body to an internal combustion engine comprising: a body having an upper surface and a lower surface opposite to the upper surface, the body having a substantially central longitudinal axis; the body defining a bore extending between the upper surface and the lower surface, the bore situated substantially parallel to the longitudinal axis; a flange extending radially from the body transverse to the central longitudinal axis, the flange situated a first distance from the central longitudinal axis; the lower surface situated for contacting the fuel injector body, the lower surface located a second distance from the central longitudinal axis, the second distance is smaller than the first distance; and a clamping device attached to the engine for exerting a clamping force on the flange.

One object of the present invention is to provide an improved distortion control ring for use with a hold down clamp to fasten a fuel injector body on the cylinder head of an internal combustion engine.

Related objects and advantages of the present invention will be apparent from the following description.

DESCRIPTION OF THE PREFERRED EMBODIMENT

Figure 1:
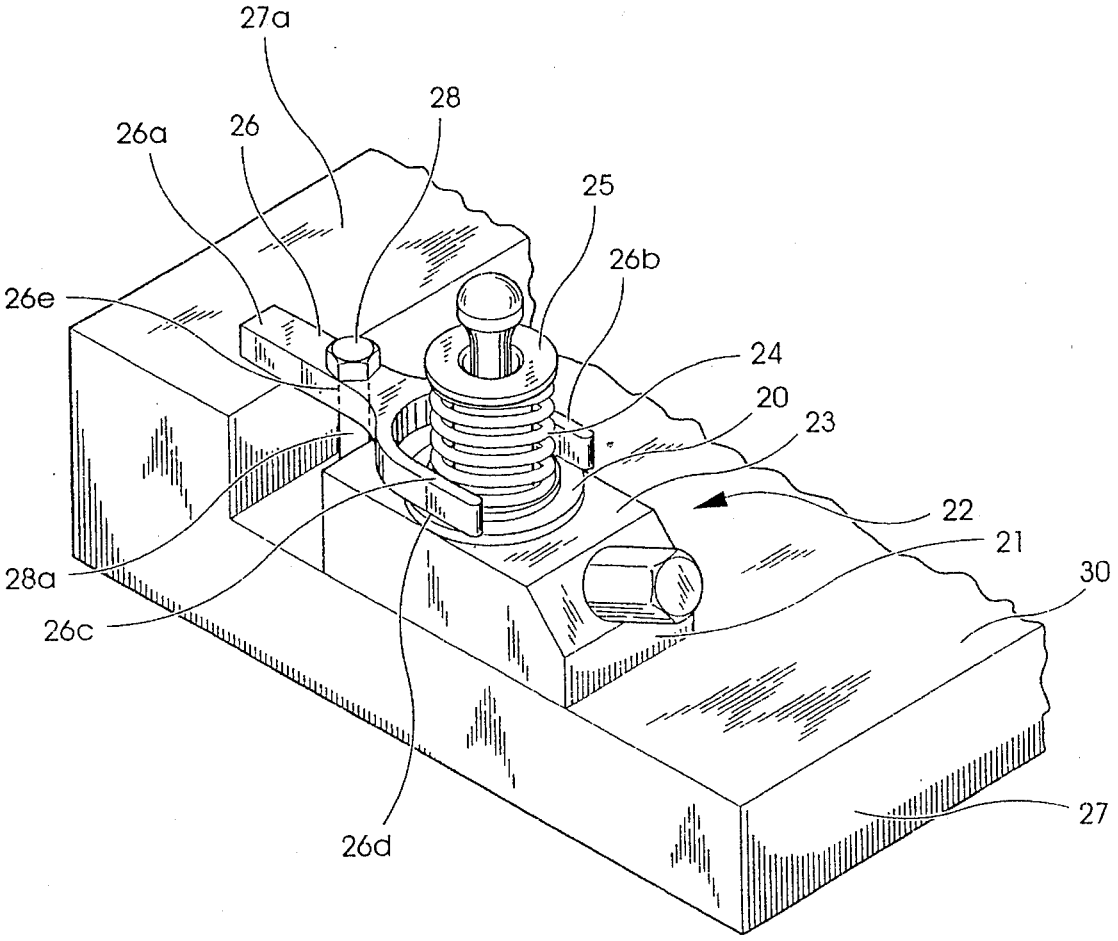
FIG. 1 is a perspective view of a distortion control ring situated between a fuel injector body and a clamp.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a distortion control ring 20 which is designed and manufactured in accordance with the present invention. Distortion control ring 20 is designed to reduce the hold down clamp static load transmitted to the outer perimeter of the fuel injector body 21. The distortion control ring 20 is assembled onto the fuel injector body 21 of the fuel injector unit 22 between the upper surface 23 of the fuel injector body 21 and the coupling return spring 24.

A hold down clamp 26is provided for securing the fuel injector body 21 to a cylinder head 27 of an internal combustion engine (not illustrated). In the preferred embodiment the hold down clamp 26 includes a first end 26*a* that contacts upper surface 27*a* of the cylinder head 27. A second opposite end of the hold down clamp 26 defines a pair of forks 26*b* and 26*c* that are formed in a spaced apart relationship with each other. A lower surface 26*d* of forks 26*b* and 26*c* is positioned to contact the distortion control ring 20 when the hold down clamp 26 is mounted to the cylinder head 27. A threaded fastener 28 has a shaft portion 28A that passes through a clearance hole 26*e* formed in the body of hold down clamp 26. In the preferred embodiment the threaded fastener is a hexhead bolt 28. It is further contemplated that the fastener could alternately be a threaded rod and nut combination. The bolt 28 engages an internally threaded bore formed within the cylinder head 27. The torquing of bolt 28 transmits a hold down clamp static load through the forks 26*b* and 26*c* to the distortion control ring 20, thereby holding the fuel injector body 21 against a deck 30 of cylinder head 27.

Figure 2:
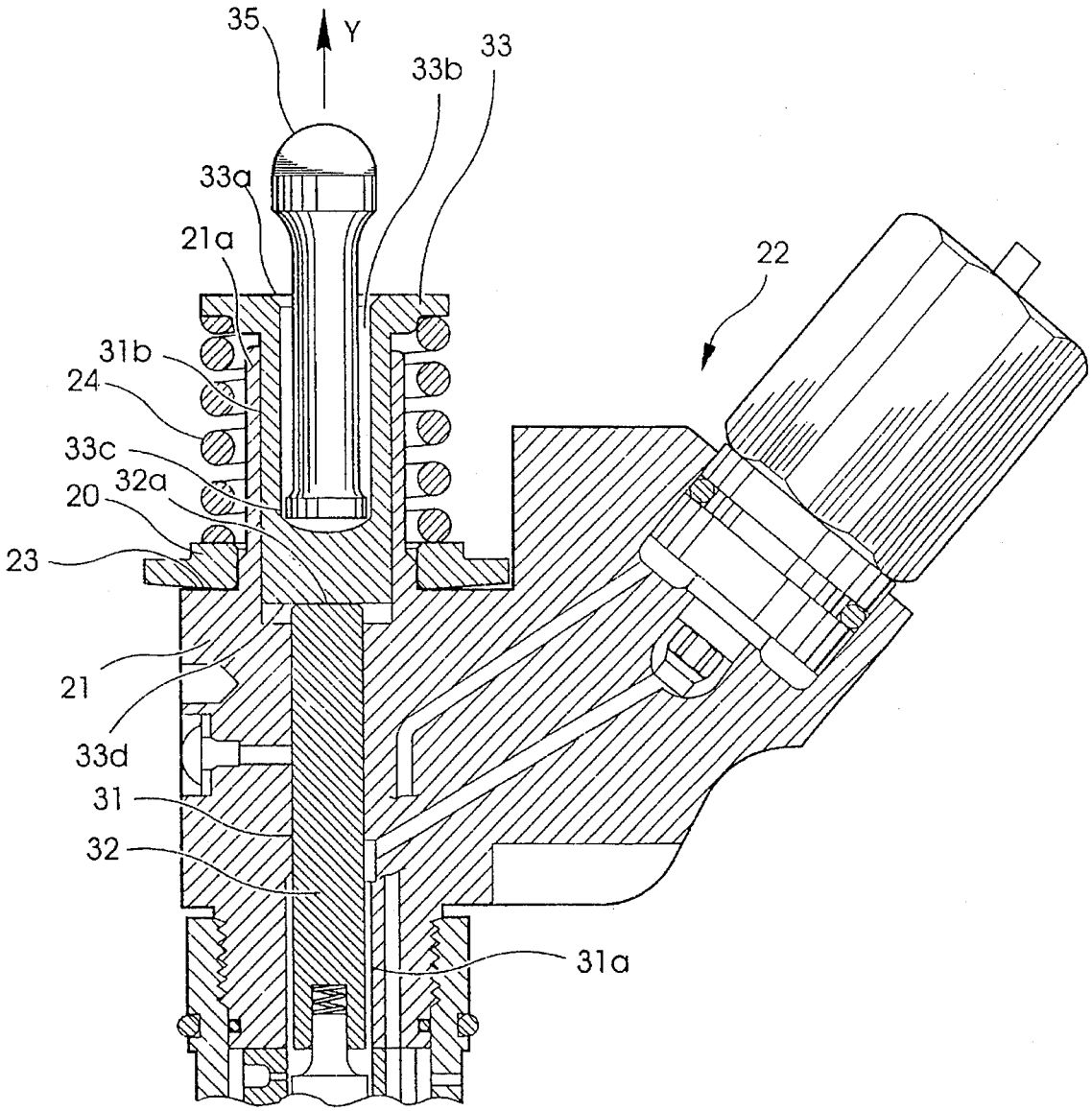
FIG. 2 is a front elevational view in full section of the FIG. 1 distortion control ring as assembled between a coupling return spring and the fuel injector body.

With reference to FIG. 2, there is illustrated the fuel injector unit 22 having a distortion control ring 20 installed between the coupling return spring 24 and the upper surface 23 of the fuel injector body 21. The fuel injector body 21 is formed preferably as a forged unit that includes an upstanding cylindrical portion 21*a*, and a central axial cavity 31 extending throughout the length of the fuel injector body 21. The axial cavity 31 is actually comprised of two coaxial and communicating cylindrical bores of different inner diameters. First cylindrical bore 31*a* is defined in fuel injector body 21 and slidably receives a timing plunger 32. The second cylindrical bore 31*b* is defined in the upstanding cylindrical portion 21*a* of the fuel injector body 21, and slidably receives a coupling member 33. At the exposed portion 33*a* of the coupling member 33 a bore 33*b*, and a load bearing surface 33*c* are formed. A push rod 35 is disposed within the bore 33*b* and contacts the load bearing surface 33*c* for transmitting a force to the coupling member 33, to overcome the spring force of coupling return spring 24. The push rod 35 functions in a well known fashion, and is typically in contact with a valve train camshaft (not shown) of the internal combustion engine. The push rod 35 reciprocates along a central axis Y in response to the angular position of the actuating valve train camshaft.

The coupling member 33 defines a lower surface 33*d* that is contactable with an upper surface 32*a* of timing plunger 32. There is no mechanical fixation or attachment between the coupling member 33 and the timing plunger 32; only a compressive load is transmitted from the coupling member 33 to the timing plunger 32. The compressive load transmitted from the coupling member 33 to the timing plunger 32 causes the axial movement of the timing plunger 32 which functions to pressurize a fuel charge disposed within the fuel injector unit 22.

Figure 3:
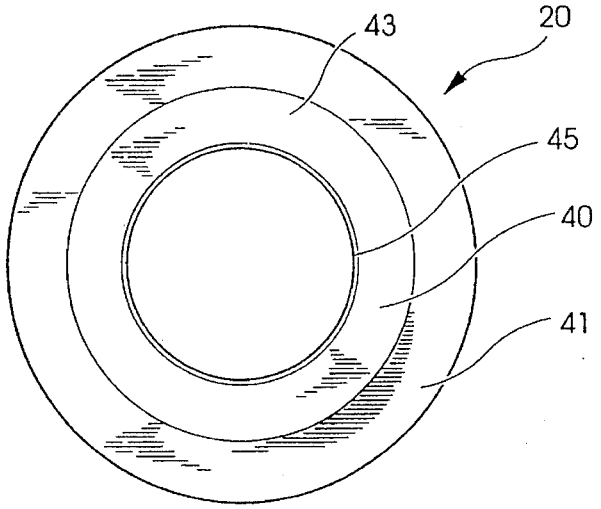
FIG. 3 is a top plan view of the FIG. 1 distortion control ring.
Figure 4:
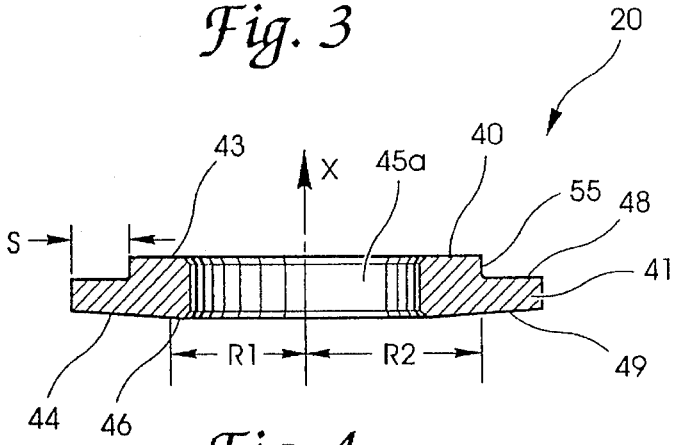
FIG. 4 is a side elevational view in full section of the FIG. 1 distortion control ring.

Referring to FIGS. 3 and 4, there is illustrated the distortion control ring 20 that can be viewed or thought of as having two portions. The two portions include a substantially cylindrical main body portion 40 and a radial flange portion 41. In the preferred embodiment, the distortion control ring 20 is of a unitary design and is formed from a steel blank. A predetermined amount of material is removed from the steel blank, by a turning process which utilizes a lathe operation or a screw machine operation,to produce the desired geometric configuration described hereinafter. Alternatively, the distortion control ring can be formed by any other suitable manner which provides durable ring with the desired dimensions.

The main body portion 40 of the distortion control ring 20 includes a first upper surface 43 and a second lower surface 44 which is disposed opposite of the first upper surface 43. The main body portion 40 is of a substantially cylindrical shape and has a bore 45 extending therethrough between first upper surface 43 and second lower surface 44. An internal diameter surface 45*a* is defined on bore 45, and this inside diameter surface is larger than the outside diameter of upstanding cylindrical portion 21*a* of fuel injector body 21. This relative difference in diameter size permits the distortion control ring 20 to be situated circumferentially around the upstanding cylindrical portion 21*a* of the fuel injector body 21.

The first upper surface 43 of main body portion 40 is formed transverse to a longitudinal centerline X of the distortion control ring 20 and is adapted for for receiving the coupling return spring 24. The second lower surface 44 defines an annular surface portion 46, having an outside radial distance R1, that is substantially parallel to the first upper surface 43 of distortion control ring 20. This annular surface portion 46 contacts the upper surface 23 of the fuel injector Body 21.

Radial flange portion 41 is formed adjacent the main body portion 40 and can be viewed as actually beginning at a radial distance R2 from the centerline X of the distortion control ring 20 and extends radially outward from the main body portion 40. A clamp engagement surface 48 and an opposite relief surface 49 are defined by the radial flange portion 41. The clamp engagement surface 48 is formed transverse to the centerline X of distortion control ring 20 and has a sufficient width S to receive the forks 26*b* and 26*c* of hold down clamp 26. Further, the clamp engagement surface 48 is substantially parallel to the upper surface 43 and the annular surface portion 46 of the distortion control ring 20.

The relief surface 49 formed on the underside of radial flange portion 41 defines an annular surface that slopes up and away in all directions from annular surface portion 46. In the preferred embodiment, relief surface 49 is formed on radial flange portion 41 at a five degree angle of inclination. As such, only the annular surface portion 46 contacts the upper surface 23 of the fuel injector body 21.

It is understood that the annular surface portion 46, which has a radial distance R1, does not extend radially outward to the radial flange portion 41 that is formed at a radial distance R2 from the centerline X of the distortion control ring 20. Once the distortion control ring 20 is situated on the upper surface 23 of the fuel injector body 21 the torquing of bolt 28 draws the forks 26*c* and 26*d* of clamp 26 against the clamp engagement surface 48 defined on the distortion control ring 20. Thus, the fuel injector body 21 is securely coupled to the cylinder head 27 of the internal combustion engine.

An additional element of distortion control ring 20 is an axial abutment surface 55 that is situated adjacent the main body portion 40 of the distortion control ring 20. In the preferred embodiment, the abutment surface 55 is situated parallel to the centerline X of the distortion control ring 20. The abutment surface 55 functions to locate where forks **26*b* and 26*c* of clamp 26 contact the distortion control ring 20**.

Figure 5:
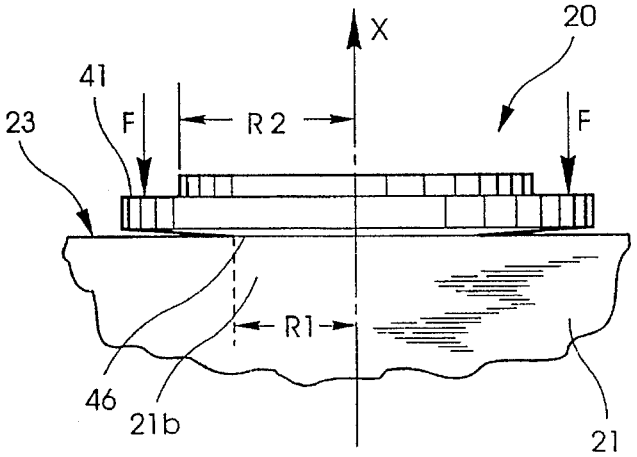
FIG. 5 is a side elevational view of the FIG. 1 distortion control ring positioned on a fuel injector body.

With reference to FIG. 5there is illustrated the distortion control ring 20 that provides a significant improvement in transmitting the static clamping load F from clamp 26 to the radial flange portion 41 of the distortion control ring 20. The distortion control ring 20 transfers the static clamping load from the radial flange portion 41 to the annular surface portion 46, which contacts the upper surface 23 of the fuel injector body 21. The geometric relationship between the radial flange portion 41, having a radial distance R2, and the annular surface portion 46, having a radial distance R1, transfers the clamping load radially inward to a substantially central portion **21*b* of the fuel injector body 21. A resulting benefit is a significant decrease in the distortion of the first cylindrical bore 31*a* which has the timing plunger 32 slidably disposed within. By decreasing the distortion of the first cylindrical bore 31*a* there is a corresponding reduction of the scuffing of timing plunger 32 (FIGS. 1 and 2). The reduction in timing plunger 32** scuffing minimizes or eliminates the occurrence of timing plunger seizure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for securing a fuel injector body to an internal combustion engine, said apparatus comprises:

a body having an upper surface and a lower surface opposite to said upper surface, said body having a substantially central longitudinal axis;

said body defining a bore extending between said upper surface and said lower surface, said bore situated substantially parallel to the central longitudinal axis;

a flange extending radially from said body transverse to the central longitudinal axis, said flange situated a first distance from the central longitudinal axis;

said lower surface situated for contacting the fuel injector body, said lower surface located a second distance from the central longitudinal axis, and wherein the second distance is smaller than the first distance; and clamping means attached to the engine for exerting a clamping force on said flange.

2. The apparatus of claim 1, wherein said upper surface is situated substantially parallel to said lower surface.

3. The apparatus of claim 2, wherein said body being substantially cylindrical.

4. The apparatus of claim 3, wherein said clamping means includes:

a clamp having a first end and an opposite second end, said first end coupled to the internal combustion engine, said second end defines a pair of spaced apart forks positioned to contact said flange; and a fastener for attaching the clamp to the internal combustion engine.

5. The apparatus of claim 4, wherein said upper surface is adapted for receiving a return spring.

6. An apparatus, disposed between a fuel injector body and a fuel injector return spring, for securing a fuel injector body to an internal combustion engine, said apparatus comprises:

a body having an upper surface and a lower surface opposite said upper surface, said body having a substantially central longitudinal axis, said upper surface adapted for mounting the fuel injector return spring;

said body defining a bore extending between said upper surface and said lower surface situated parallel with the central longitudinal axis;

a flange extending from said body generally transverse to the central longitudinal axis, said flange located a first distance from the central longitudinal axis;

said lower surface located a second distance from the central longitudinal axis, said lower surface situated for contacting the fuel injector body, the second distance is smaller than the first distance; and a clamping device coupled to the engine for exerting a clamping load on said flange.

7. The apparatus of claim 6, wherein said upper surface is situated substantially parallel to said lower surface.

8. The apparatus of claim 7, wherein said body being substantially cylindrical.

9. The apparatus of claim 8, wherein said clamping device has a first end and an opposite second end, said first end being coupled to the internal combustion engine, said second end defines a pair of forks positioned for contacting said flange.

10. The apparatus of claim 9, wherein said clamping device further includes a fastener for coupling the clamping device to the internal combustion engine.

11. The apparatus of claim 10, wherein said upper surface is adapted for receiving a return spring.

12. An apparatus situated between a fuel injector body and a clamp, said apparatus comprises:

a body defining a main portion and a flange portion, said body having a substantially central longitudinal axis;

said main portion having an upper surface and a lower surface opposite said upper surface, said main portion defining a bore extending between said upper surface and said lower surface in a direction substantially parallel to the central axis;

said lower surface situated radially a first distance from the central axis, said lower surface contacts the fuel injector body; and said flange portion is situated adjacent said main portion, said flange portion is located a second distance from the central axis, said second distance is greater than said first distance, said flange portion positioned for receiving the clamp.

13. The apparatus of claim 12, wherein said upper surface is positioned parallel to said lower surface.

14. The apparatus of claim 13, wherein said body being substantially cylindrical.

15. The apparatus of claim 14, wherein said clamp includes a first end and an opposite second end, said first end being coupled to an internal combustion engine, said second end defines a pair of spaced apart forks positioned to contact said flange portion.

16. The apparatus of claim 15, further comprising a fastener for coupling the clamp with the internal combustion engine.

* * * * *